US007597633B2

(12) United States Patent
Shimazaki et al.

(10) Patent No.: US 7,597,633 B2
(45) Date of Patent: Oct. 6, 2009

(54) GOLF CLUB HEAD

(75) Inventors: Hideo Shimazaki, Tokyo (JP); Hideo Matsunaga, Saitama (JP); Wataru Ban, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 385 days.

(21) Appl. No.: 11/451,401

(22) Filed: Jun. 13, 2006

(65) Prior Publication Data

US 2007/0129166 A1 Jun. 7, 2007

(30) Foreign Application Priority Data

Dec. 5, 2005 (JP) ..... 2005-351284

(51) Int. Cl.
*A63B 53/04* (2006.01)

(52) U.S. Cl. ..... 473/329; 473/332; 473/349; 473/350

(58) Field of Classification Search ..... 473/324–350
See application file for complete search history.

(56) References Cited

U.S. PATENT DOCUMENTS

| | | | |
|---|---|---|---|
| 2,846,228 A | 8/1958 | Reach | |
| 3,084,940 A | 4/1963 | Cissel | |
| 4,804,188 A | 2/1989 | McKee et al. | |
| 4,811,950 A | 3/1989 | Kobayashi | |
| 4,928,972 A | 5/1990 | Nakanishi et al. | |
| 5,290,036 A | 3/1994 | Fenton et al. | |
| 5,299,807 A | 4/1994 | Hutin | |
| 5,316,298 A | 5/1994 | Hutin et al. | |
| 5,316,305 A | 5/1994 | McCabe | |
| 5,351,958 A | 10/1994 | Helmstetter | |
| 5,362,055 A | 11/1994 | Rennie | |
| 5,409,229 A | 4/1995 | Schmidt et al. | |
| 5,411,255 A | 5/1995 | Kurashima et al. | |
| 5,431,396 A * | 7/1995 | Shieh | 473/329 |

(Continued)

FOREIGN PATENT DOCUMENTS

EP 1757334 A1 2/2007

(Continued)

OTHER PUBLICATIONS

U.S. Appl. No. 11/434,899, filed May 17, 2006 by Hideo Matsunaga.*

(Continued)

*Primary Examiner*—Sebastiano Passaniti
(74) *Attorney, Agent, or Firm*—Sughrue Mion, PLLC

(57) ABSTRACT

This invention provides a golf club head comprising a head main body, a face plate fixed to a front surface side of the head main body to form a face surface, a cavity portion formed in the head main body and open to a face plate side, and a viscoelastic body inserted in a compressed state in a space formed by the cavity portion and the face plate. An end face on the face plate side of a circumferential wall defining the cavity portion comprises a contacting portion contacting with a rear surface of the face plate, and a non-contacting portion spaced apart from the rear surface of the face plate to form a gap communicating with the cavity portion between the non-contacting portion and the rear surface of the face plate.

11 Claims, 4 Drawing Sheets

U.S. PATENT DOCUMENTS

| | | | | |
|---|---|---|---|---|
| 5,492,327 | A | 2/1996 | Biafore, Jr. | |
| 5,529,543 | A * | 6/1996 | Beaumont, Sr. | 473/290 |
| 5,564,705 | A | 10/1996 | Kbbayashi et al. | |
| 5,586,947 | A | 12/1996 | Hutin | |
| 5,643,111 | A | 7/1997 | Igarashi | |
| 5,692,972 | A | 12/1997 | Langslet | |
| 5,697,855 | A | 12/1997 | Aizawa | |
| 5,703,294 | A | 12/1997 | McConnell et al. | |
| 5,766,092 | A | 6/1998 | Mimeur et al. | |
| 5,766,093 | A * | 6/1998 | Rohrer | 473/329 |
| 6,045,456 | A * | 4/2000 | Best et al. | 473/291 |
| 6,093,116 | A | 7/2000 | Hettinger et al. | |
| 6,265,475 | B1 | 7/2001 | Chifei et al. | |
| 6,302,807 | B1 | 10/2001 | Rohrer | |
| 6,431,997 | B1 * | 8/2002 | Rohrer | 473/324 |
| 6,616,546 | B2 * | 9/2003 | Cho | 473/329 |
| 6,642,308 | B2 | 11/2003 | Nomura et al. | |
| 6,672,975 | B1 | 1/2004 | Galloway | |
| 6,688,989 | B2 | 2/2004 | Best | |
| 6,743,114 | B2 * | 6/2004 | Best | 473/291 |
| 6,743,117 | B2 | 6/2004 | Gilbert | |
| 6,773,360 | B2 | 8/2004 | Willett et al. | |
| 6,780,123 | B2 | 8/2004 | Hasebe | |
| 6,835,144 | B2 * | 12/2004 | Best | 473/332 |
| 6,855,066 | B2 * | 2/2005 | Best | 473/291 |
| 6,902,495 | B2 | 6/2005 | Pergande et al. | |
| 6,984,180 | B2 | 1/2006 | Hasebe | |
| 6,991,559 | B2 | 1/2006 | Yabu | |
| 6,991,560 | B2 | 1/2006 | Tseng | |
| 7,048,647 | B2 | 5/2006 | Burrows | |
| 7,108,613 | B1 | 9/2006 | Gordon et al. | |
| 7,119,146 | B2 | 10/2006 | Tse et al. | |
| 7,182,698 | B2 * | 2/2007 | Tseng | 473/332 |
| 7,189,169 | B2 | 3/2007 | Billings | |
| 7,207,899 | B2 * | 4/2007 | Imamoto | 473/332 |
| 7,226,366 | B2 | 6/2007 | Galloway | |
| 7,303,485 | B2 * | 12/2007 | Tseng | 473/332 |
| 7,303,486 | B2 * | 12/2007 | Imamoto | 473/332 |
| 7,316,623 | B2 * | 1/2008 | Imamoto | 473/332 |
| 7,371,190 | B2 | 5/2008 | Gilbert et al. | |
| 2003/0027662 | A1 | 2/2003 | Werner et al. | |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 | 12/2004 | Gilbert et al. | |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0197208 | A1 | 9/2005 | Imamoto | |
| 2006/0258480 | A1 | 11/2006 | Hou et al. | |
| 2007/0049400 | A1 | 3/2007 | Imamoto et al. | |
| 2007/0129160 | A1 | 6/2007 | Matsunaga et al. | |
| 2007/0129161 | A1 | 6/2007 | Matsunaga et al. | |
| 2007/0129162 | A1 * | 6/2007 | Pan et al. | 473/332 |
| 2007/0129164 | A1 | 6/2007 | Shimazaki et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2007/0149313 | A1 | 6/2007 | Matsunaga et al. | |
| 2008/0020860 | A1 * | 1/2008 | Imamoto | 473/332 |

FOREIGN PATENT DOCUMENTS

| | | | |
|---|---|---|---|
| FR | 2717701 | A1 | 9/1995 |
| JP | 01-166779 | A | 6/1989 |
| JP | 05-028361 | U | 4/1993 |
| JP | 05147096 | A | 6/1993 |
| JP | 06-007486 | A | 1/1994 |
| JP | 06254183 | A | 9/1994 |
| JP | 06-319836 | A | 11/1994 |
| JP | 07-27630 | U | 5/1995 |
| JP | 07-148291 | A | 6/1995 |
| JP | 07-213656 | A | 8/1995 |
| JP | 08-206258 | A | 8/1996 |
| JP | 09-000666 | A | 1/1997 |
| JP | 09-122281 | A | 5/1997 |
| JP | 11114112 | A | 4/1999 |
| JP | 2000-116824 | A | 4/2000 |
| JP | 2000197718 | A | 7/2000 |
| JP | 2001000606 | A | 1/2001 |
| JP | 2001-170225 | A | 6/2001 |
| JP | 2004-313777 | A | 11/2001 |
| JP | 2003-093550 | A | 4/2003 |
| JP | 2003-102877 | A | 4/2003 |
| JP | 2003-250939 | A | 9/2003 |
| JP | 2003-265652 | A | 9/2003 |
| JP | 2003-265653 | A | 9/2003 |
| JP | 2003260153 | A | 9/2003 |
| JP | 2004-089434 | A | 3/2004 |
| JP | 2005-006763 | A | 1/2005 |
| JP | 2005-160947 | A | 6/2005 |
| JP | 2005-160948 | A | 6/2005 |
| JP | 3112038 | U | 6/2005 |
| JP | 2005-218510 | A | 8/2005 |
| JP | 2005-245519 | A | 9/2005 |
| JP | 2006000139 | A | 1/2006 |
| JP | 2006000435 | A | 1/2006 |
| WO | 9920358 | A1 | 4/1999 |

OTHER PUBLICATIONS

U.S. Appl. No. 11/435,984, filed May 18, 2006 by Hideo Matsunaga.*

U.S. Appl. No. 11/435,989, filed May 18, 2006 by Hideo Matsunaga.*

U.S. Appl. No. 11/455,739, filed Jun. 20, 2006 by Hideo Matsunaga.*

U.S. Appl. No. 11/474,419, filed Jun. 26, 2006 by Hideo Shimazaki.*

U.S. Appl. No. 11/434,191, filed May 16, 2006 by Hideo Matsunaga.*

* cited by examiner

GOLF CLUB HEAD

FIELD OF THE INVENTION

The present invention relates to a golf club head and, more particularly, to a structure of inserting a viscoelastic body in a golf club head.

BACKGROUND OF THE INVENTION

A golf club head having a viscoelastic body on the rear surface of a face plate which forms a face surface has been proposed to improve the hitting impression or adjust the hitting sound on impact (Japanese Patent Laid-Open Nos. 2004-89434 and 2005-218510). When the viscoelastic body is loaded on the rear surface of the face plate, the vibration on impact is absorbed by the viscoelastic body to improve the hitting impression and decrease the hitting sound that is offensive to the player's ear.

In order to effectively control vibration on impact by a viscoelastic body, the viscoelastic body is desirably in tight contact with the rear surface of a face plate. For this structure, desirably, the viscoelastic body is inserted in a compressed state in the inserting space formed by a head main body and the face plate of a golf club head.

In order to insert the viscoelastic body in a compressed state, the viscoelastic body needs to be formed slightly larger than the inserting space so as to ensure the compression margin. If a large compression margin is ensured, however, when fixing the face plate to the head main body, the head main body and face plate may bite into the viscoelastic body. This interferes with the assembly operation of the golf club head. In contrast, if a small compression margin is ensured, the tight contact between the viscoelastic body and face plate decreases, or the tight contact area between the viscoelastic body and face plate decreases.

SUMMARY OF THE INVENTION

The present invention has been made in order to overcome the deficits of prior art.

According to the aspects of the present invention, there is provided a golf club head comprising a head main body, a face plate fixed to a front surface side of the head main body to form a face surface, a cavity portion formed in the head main body and open to a face plate side, and a viscoelastic body inserted in a compressed state in a space formed by the cavity portion and the face plate, wherein an end face on the face plate side of a circumferential wall defining the cavity portion comprises a contacting portion contacting with a rear surface of the face plate, and a non-contacting portion spaced apart from the rear surface of the face plate to form a gap communicating with the cavity portion between the non-contacting portion and the rear surface of the face plate.

In the golf club head, the gap is formed by the non-contacting portion. Thus, a part of the viscoelastic body in a compressed state is allowed to extend into the gap. Even if the compression margin of the viscoelastic body is increased, when fixing the face plate to the head main body, the head main body and face plate can be prevented from biting into the viscoelastic body. Since part of the viscoelastic body extends into the gap, the tight contact area between the viscoelastic body and face plate also increase more.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
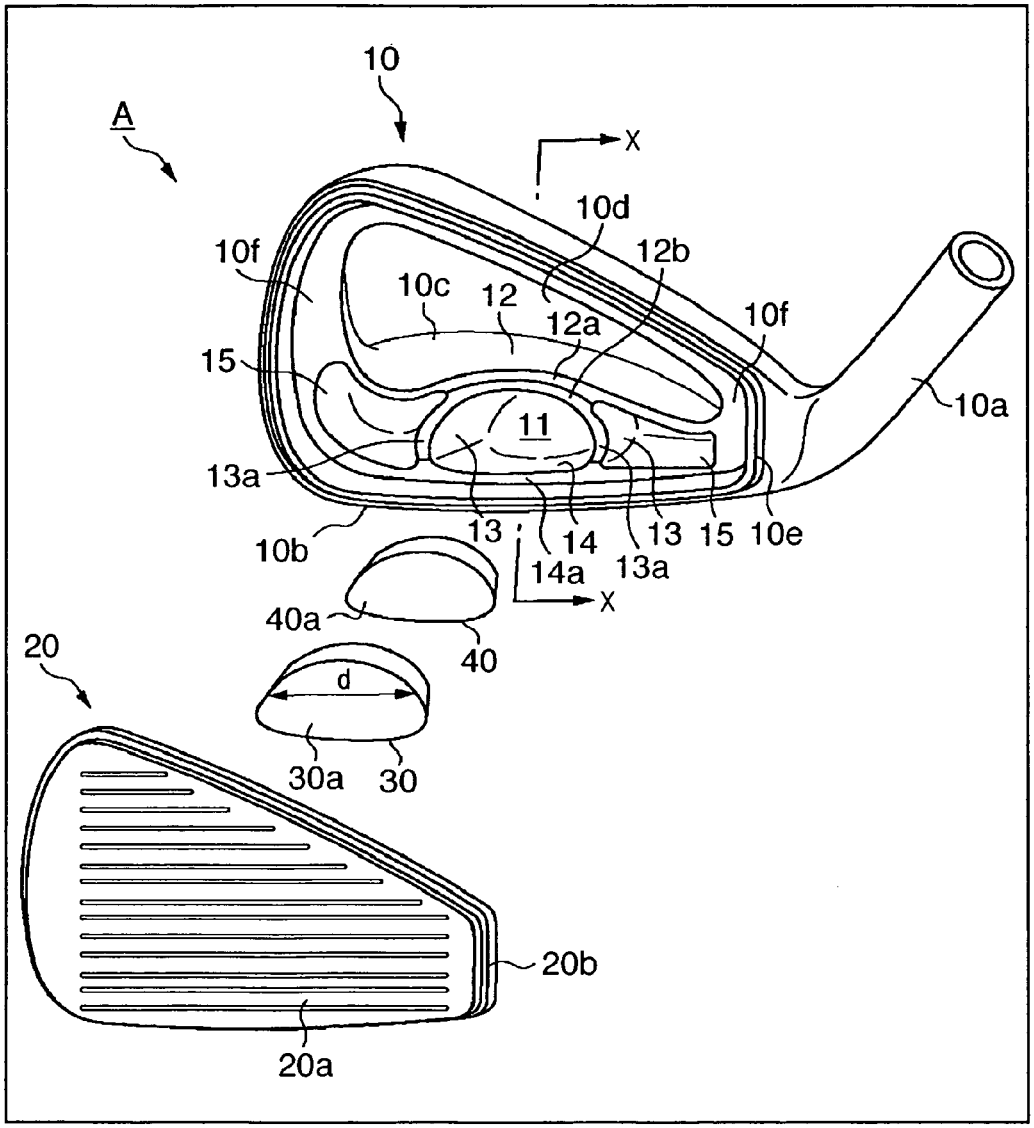
FIG. 1 is an exploded perspective view of a golf club head A according to one embodiment of the present invention.
Figure 2A:
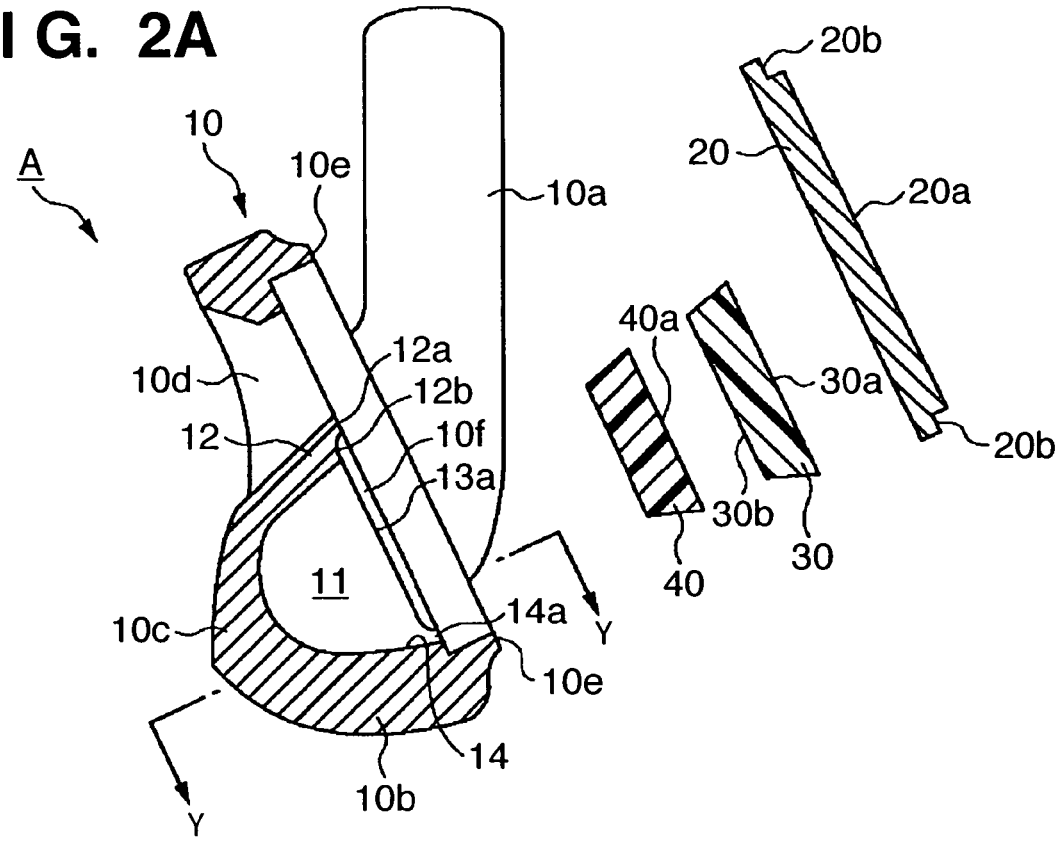
FIG. 2A is a sectional view of the golf club head A in an exploded state taken along the line X-X of FIG. 1.
Figure 2B:
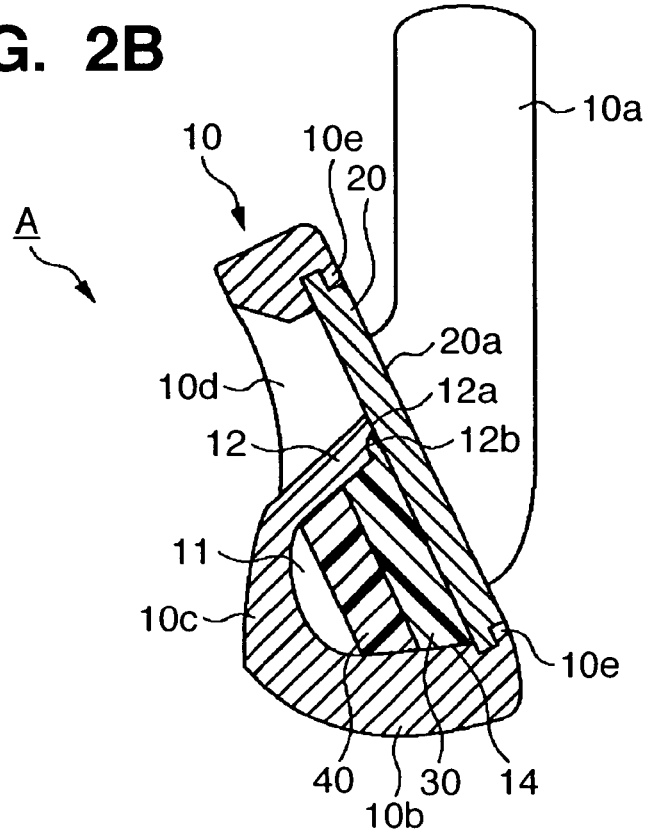
FIG. 2B is a sectional view of the golf club head A in an assembled state taken along the line X-X of FIG. 1.
Figure 3:
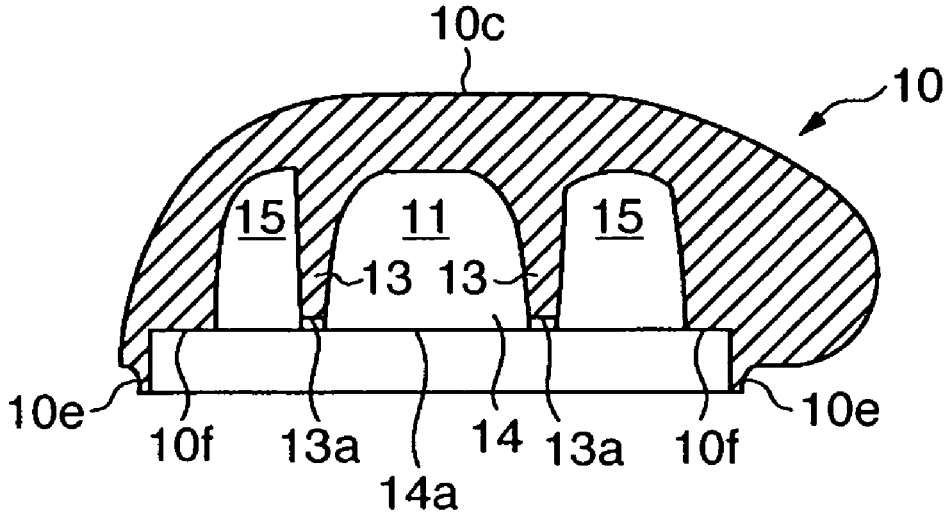
FIG. 3 is a sectional view taken along the line Y-Y of FIG. 2A.

FIG. 1 is an exploded perspective view of a golf club head A according to one embodiment of the present invention, FIG. 2A is a sectional view of the golf club head A in an exploded state taken along the line X-X of FIG. 1, FIG. 2B is a sectional view of the golf club head A in an assembled state taken along the line X-X of FIG. 1, and FIG. 3 is a sectional view taken along the line Y-Y of FIG. 2A.

The golf club head A is an iron type golf club head and includes a head main body 10 and a face plate 20 which is fixed to the front surface side of the head main body 10 to form a face surface 20*a*. Although this embodiment is exemplified by an iron type golf club head, the present invention can also be applied to another type of golf club head.

The head main body 10 integrally has a hosel portion 10*a* to be connected to a shaft, a sole portion 10*b*, and a back portion 10*c*, and is made of, e.g., stainless steel or soft iron. An opening 10*d* is formed in the upper portion of the head main body 10 to extend from the front surface side to the rear surface side, thus decreasing the weight and lowering the center of gravity of the head main body 10. A rib 10*e* which defines the space where the face plate 20 is to be fixed and a contacting portion 10*f* with which the rear surface of the face plate 20 is to contact is formed on the front surface of the head main body 10.

The face plate 20 is formed with the face surface 20*a* on its front surface and a stepped portion 20*b* formed at its circumference. The rear surface of the face plate 20 forms a flat surface. For example, the face plate 20 is made of stainless steel, maraging steel, brass, a copper alloy (e.g., beryllium copper or bronze), titanium, a titanium alloy, duralumin, an amorphous metal, an FRM, or the like.

A cavity portion 11 is formed in the head main body 10 to open to the face plate 20 side and be closed on the back portion 10*c* side. The cavity portion 11 is defined by circumferential walls 12 to 14 integrally formed with the head main body 10. Of the end faces on the face plate 20 side of the circumferential walls 12 to 14, that end face of the circumferential wall 12 which is above cavity portion 11 has an contacting portion 12*a* which is flush with the contacting portion 10*f* and contacts with the rear surface of the face plate 20, and a non-contacting portion 12*b* which is spaced apart from the rear surface of the face plate 20 inside the contacting portion 12*a*. The end face of the circumferential wall 14 which is at the bottom of the cavity portion 11 comprises only an contacting portion 14*a* which is flush with the contacting portion 10*f* and contacts with the rear surface of the face plate 20. Those end faces of the circumferential wall 13 which are on the two sides of the cavity portion 11 have non-contacting portions 13*a* which are spaced apart from the rear surface of the face plate 20 and flush with the non-contacting portion 12*b*. Unlike the non-contacting portion 12*b*, the non-contacting portions 13*a* are formed throughout the entire range in the direction of thickness of the circumferential wall 13.

A viscoelastic body 30 is inserted in a compressed state in the space formed by the cavity portion 11 and face plate 20. The viscoelastic body 30 is made of, e.g., a viscoelastic material such as NBR (acrylonitrile-butadiene rubber). The viscoelastic body 30 can also be formed by mixing a metal powder or the like in the viscoelastic material described above, to adjust their specific gravities. In this embodiment, a spacer member 40 is loaded in the cavity portion 11 in addition to the viscoelastic body 30. The spacer member 40 is inserted to press the viscoelastic body 30 against the face plate side.

Second cavity portions 15 are formed on the two sides of the cavity portion 11. The cavity portions 15 serve to decrease the weight of the head main body 10. Although the cavity portions 15 are formed on the two sides of the cavity portion 11 in this embodiment, the cavity portion 15 can be formed on only one side of the cavity portion 11. Although the cavity portions 15 are left hollow in this embodiment, weights or the like to adjust the barycentric position of the golf club head A can be inserted in the cavity portions 15.

When assembling the golf club head A having the above structure, first, the viscoelastic body 30 and spacer member 40 are inserted in the cavity portion 11 of the head main body 10. Then, as shown in FIG. 2B, the face plate 20 is inserted in the mounting space of the head main body 10 defined by the rib 10*e* such that the rear surface of the face plate 20 tightly contacts with the contacting portion 10*f* of the head main body 10. After that, the rib 10*e* is caulked with the stepped portion 20*b* of the face plate 20 to fix the face plate 20 to the head main body 10. The viscoelastic body 30 and spacer member 40 are designed in size such that the viscoelastic body 30 is compressed between the spacer member 40 and face plate 20.

In the golf club head A according to this embodiment, when the non-contacting portions 12*b* and 13*a* are formed on the end faces of the circumferential walls 12 and 13 that define the cavity portion 11, a gap communicating with the cavity portion 11 is formed in the end faces of the circumferential walls 12 and 13. Thus, part of the viscoelastic body 30 in a compressed state is allowed to extend into the gap. FIG. 2B shows a state wherein part of the viscoelastic body 30 extends into the gap between the non-contacting portion 12*b* and face plate 20. Even if the compression margin of the viscoelastic body 30 is increased, when attaching the face plate 20 to the head main body 10, the head main body 10 and face plate 20 can be prevented from biting into the viscoelastic body 30. Particularly, in this embodiment, as the gap formed by the non-contacting portions 13*a* communicates not only with the cavity portion 11 but also with the cavity portions 15, the allowable extension amount of the viscoelastic body 30 increases, so that the head main body 10 and face plate 20 can be more prevented from biting into the viscoelastic body 30. Since part of the viscoelastic body 30 extends into the gap between the non-contacting portions 12*b* and 13*a* and face plate 20, the tight contact area between the viscoelastic body 30 and face plate 20 also increases more.

According to this embodiment, the front surface 30*a* and rear surface 30*b* of the viscoelastic body 30 are parallel to each other to form a plate which has a uniform thickness except for its circumferential portion. The front surface 40*a* of the spacer member 40 forms a flat surface that contacts with the rear surface of the viscoelastic body 30. The viscoelastic body 30, spacer member 40, and cavity portion 11 are designed in shape such that their front surface 30*a*, rear surface 30*b*, and front surface 40*a* are parallel to the rear surface of the face plate 20. With this structure, the front surface 30*a* of the viscoelastic body 30 comes into tight contact with the rear surface of the face plate 20 with a substantially uniform pressure, thus improving the tight contact state.

In this embodiment, the cavity portion 11 is formed in the lower side of the head main body 10, and the viscoelastic body 30 inserted in the cavity portion 11 is located in the lower side of the head main body 10. This structure can lower the barycentric position of the golf club head A, thus achieving a low center of gravity. An iron type golf club hits a golf ball with its point close to the lower portion of the face surface 20*a*. Thus, the viscoelastic body 30 is located substantially behind the position of the golf ball hitting point, so that the vibration damping effect of the viscoelastic body 30 can improve.

In this embodiment, the width (d in FIG. 1) in a direction along the face plate 20 of the viscoelastic body 30 increases downward from its upper portion, and the cavity portion 11 has a shape to match this. Hence, the barycentric position of the viscoelastic body 30 is low. This can lower the barycentric position of the golf club head A, thus further achieving a low center of gravity.

In this embodiment, the spacer member 40 is formed. However, the rear face side of the cavity portion 11 can directly abut against the rear surface 30*b* of the viscoelastic body 30 without forming the spacer member 40. In order to decrease the weight of the head main body 10, however, the cavity portion 11 is desirably formed as large as possible. Therefore, by forming the spacer member 40 and making the spacer member 40 of a material having specific gravity smaller than that of the head main body 10, the weight of the head main body 10 can be decreased.

Frequency of vibration of a golf club head on impact varies in a wide range. The frequency band in which a viscoelastic material effectively absorbs vibration is limited to a certain range in accordance with the viscoelastic material. Therefore, the spacer member 40 can be a viscoelastic body with vibration damping performance different from that of the viscoelastic body 30. With this structure, the vibration damping effect can be improved with respect to the vibration in a wider frequency range. For example, the viscoelastic body 30 and spacer member 40 can be made of viscoelastic materials with loss coefficients (so-called tan δ) temperature dependences of which are different. This is because when the temperature dependences of loss coefficients differ, the frequency bands in which vibration is effectively absorbed are different.

In the above embodiment, the viscoelastic body 30 is formed as a single component. However, a plurality of types of viscoelastic bodies with different vibration damping performances can be inserted in a compressed state in the space formed by the cavity portion 11 and face plate 20. FIGS. 4A to 4E are views showing such examples. The frequency of the vibration of a golf club head changes depending on the position of the golf ball hitting point. In the examples of FIGS. 4A to 4E, viscoelastic bodies with different vibration damping performances are disposed in accordance with the position of the golf ball hitting point, so as to be effective in reducing vibration at various frequencies.

Figure 4A:
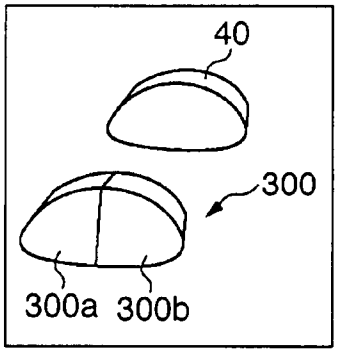
FIGS. 4A to 4E are views showing examples of a viscoelastic body to be loaded in the golf club head A.

In FIG. 4A, a viscoelastic body 300 which replaces the viscoelastic body 30 is horizontally divided to form viscoelastic bodies 300*a* and 300*b* having different vibration damping performances. This structure copes with a golf club head that generates vibration of different frequencies between cases wherein the position of the golf ball hitting point is close to the heel and is close to the toe.

Figure 4B:
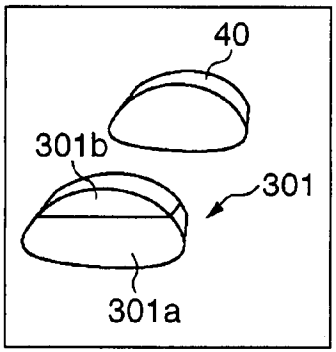

In FIG. 4B, a viscoelastic body 301 which replaces the viscoelastic body 30 is vertically divided to form viscoelastic bodies 301*a* and 301*b* having different vibration damping performances. This structure copes with a golf club head that generates vibration of different frequencies between cases wherein the position of the golf ball hitting point is on the upper side and is on the lower side.

Figure 4C:
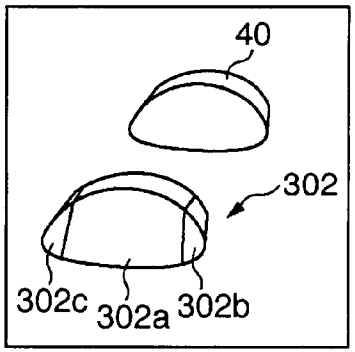

In FIG. 4C, a viscoelastic body 302 which replaces the viscoelastic body 30 is horizontally divided into three portions to form viscoelastic bodies 302*a*, 302*b*, and 302*c* having different vibration damping performances. This structure copes with a golf club that generates vibration of different frequencies among cases wherein the position of the golf ball hitting point is in the vicinity of the so-called sweet spot, is close to the heel, and is close to the toe.

Figure 4D:
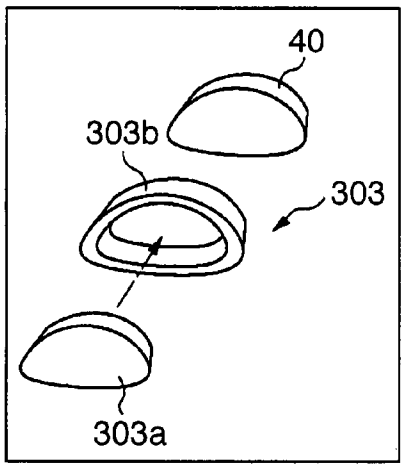
Figure 4E:
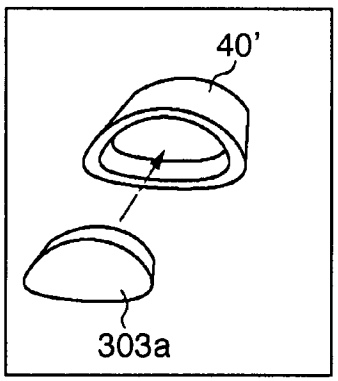

In FIG. 4D, a viscoelastic body 303 which replaces the viscoelastic body 30 is divided in the direction of its thickness to form viscoelastic bodies 303*a* and 303*b* having different vibration damping performances. The viscoelastic body 303*b* is configured to cover the circumferential surface and rear portion of the viscoelastic body 303*a*. This structure copes with a golf club head that generates vibration of different frequencies between a case wherein the position of the golf ball hitting point is in the vicinity of the so-called sweet spot, and the other cases. In FIG. 4E, the case of FIG. 4D is modified by integrating the viscoelastic body 303*b* and the spacer member 40 to form a viscoelastic body 40'.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-351284 filed on Dec. 5, 2005, which is hereby incorporated by reference herein in its entirety.

What is claimed is:

1. An iron type golf club head comprising:

a head main body having a front surface side and a rear surface side;

a face plate fixed to the front surface side of said head main body to form a face surface of said golf club head;

a cavity portion formed in said head main body, said cavity portion open to the front surface side and closed by the rear surface side; and a viscoelastic body inserted in a compressed state in a space formed by said cavity portion, wherein an axial edge on the front surface of a circumferential wall defining said cavity portion comprises:

a contacting portion that contacts a rear surface of said face plate; and a non-contacting portion spaced apart from the rear surface of said face plate to form a gap communicating with said cavity portion between said non-contacting portion and the rear surface of said face plate.

2. The head according to claim 1, wherein a front surface and a rear surface of said viscoelastic body are parallel to each other.

3. The head according to claim 2, further comprising a spacer member inserted in said cavity portion on a rear surface side of said viscoelastic body, wherein said spacer member has a flat surface contacting with said rear surface of said viscoelastic body and presses said viscoelastic body against the face plate side.

4. The head according to claim 3, wherein said spacer member comprises a viscoelastic body with vibration damping performance different from that of said viscoelastic body.

5. The head according to claim 1, wherein a plurality of types of viscoelastic bodies with different vibration damping performance are inserted in a compressed state in a space formed by said cavity portion and said face plate.

6. The head according to claim 1, wherein a width of said viscoelastic body in a direction along said face plate increases downward from an upper portion of said viscoelastic body.

7. The head according to claim 1, wherein said cavity portion is formed on a lower portion side of said head main body.

8. The head according to claim 1, wherein said head main body comprises a second cavity portion formed on a side of said cavity portion.

9. An iron type golf club head comprising:

a head main body;

a face plate fixed to a front surface side of said head main body to form a face surface;

a cavity portion formed in said head main body and open to a face plate side;

a viscoelastic body inserted in a compressed state in a space formed by said cavity portion and said face plate; and a spacer member inserted in said cavity portion on a rear surface side of said viscoelastic body, wherein a front surface and a rear surface of said viscoelastic body are parallel to each other, wherein said spacer member has a flat surface contacting with said rear surface of said viscoelastic body and presses said viscoelastic body against the face plate side, and wherein an end face on the face plate side of a circumferential wall defining said cavity portion comprises:

a contacting portion contacting with a rear surface of said face plate, and a non-contacting portion spaced apart from the rear surface of said face plate to form a gap communicating with said cavity portion between said non-contacting portion and the rear surface of said face plate.

10. The head according to claim 9, wherein said spacer member comprises a viscoelastic body with vibration damping performance different from that of said viscoelastic body.

11. An iron type golf club head comprising:

a head main body;

a face plate fixed to a front surface side of said head main body to form a face surface;

a cavity portion formed in said head main body and open to a face plate side; and a viscoelastic body inserted in a compressed state in a space formed by said cavity portion and said face plate, wherein an end face on the face plate side of a circumferential wall defining said cavity portion comprises:

a contacting portion contacting with a rear surface of said face plate; and a non-contacting portion spaced apart from the rear surface of said face plate to form a gap communicating with said cavity portion between said non-contacting portion and the rear surface of said face plate, and wherein said head main body comprises a second cavity portion formed on a side of said cavity portion.

* * * * *